US006630247B1

(12) United States Patent
Fox et al.

(10) Patent No.: US 6,630,247 B1
(45) Date of Patent: Oct. 7, 2003

(54) CERAMIC-METAL COMPOSITE AND METHOD TO FORM SAID COMPOSITE

(75) Inventors: Richard T. Fox, Midland, MI (US); Chan Han, Midland, MI (US); Aleksander J. Pyzik, Midland, MI (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 09/921,810

(22) Filed: Aug. 3, 2001

Related U.S. Application Data

(62) Division of application No. 09/133,109, filed on Aug. 12, 1998.

(51) Int. Cl.[7] ..... C22C 21/00; C22C 1/10

(52) U.S. Cl. ..... 428/539.5; 148/437; 420/528; 428/545

(58) Field of Search ..... 420/528; 148/437, 148/438, 439, 440; 428/545, 539.5

(56) References Cited

U.S. PATENT DOCUMENTS

| | | | | |
|---|---|---|---|---|
| 3,718,441 | A | 2/1973 | Landingham | 29/182.1 |
| 3,864,154 | A | 2/1975 | Gazza et al. | 29/123 B |
| 4,718,941 | A | 1/1988 | Halverson et al. | 75/236 |
| 4,885,130 | A | 12/1989 | Claar et al. | 419/12 |
| 4,935,055 | A | 6/1990 | Aghajanian et al. | 164/66.1 |
| 4,981,632 | A | 1/1991 | Claar et al. | 264/60 |
| 5,000,245 | A | 3/1991 | White et al. | 164/97 |
| 5,007,476 | A | 4/1991 | Newkikrk et al. | 164/97 |
| 5,163,498 | A | 11/1992 | Kantner et al. | |
| 5,196,238 | A | 3/1993 | Pyzik et al. | 427/347 |
| 5,238,883 | A | 8/1993 | Newkirk et al. | 501/87 |
| 5,296,417 | A | 3/1994 | Claar et al. | 419/12 |
| 5,299,621 | A | 4/1994 | Claar et al. | 164/98 |
| 5,316,069 | A | 5/1994 | Aghajanian et al. | |
| 5,372,178 | A | 12/1994 | Claar et al. | 164/98 |
| 5,521,016 | A | 5/1996 | Pyzik et al. | 428/568 |
| 5,549,151 | A | 8/1996 | Yang | 164/97 |
| 5,595,622 | A | 1/1997 | Pyzik et al. | 156/89 |
| 5,848,349 | A | 12/1998 | Newkirk et al. | 419/10 |

*Primary Examiner*—George Wyszomierski
*Assistant Examiner*—Janelle Combs Morillo

(57) ABSTRACT

A ceramic-metal composite that is tough and stiff has been prepared and is comprised of an inert ceramic (e.g., alumina) embedded and dispersed in a matrix comprised of a metal (e.g., aluminum), a reactive ceramic (e.g., boron carbide) and a reactive ceramic-metal reaction product (e.g., $AlB_2$, $Al_4BC$, $Al_3B_{48}C_2$, $AlB_{12}$, $Al_4C_3$, $AlB_{24}C_4$ or mixtures thereof) wherein grains of the inert ceramic have an average grain size greater than or equal to the average grain size of grains of the reactive ceramic. The ceramic-metal composite may be prepared by forming a mixture comprised of an inert ceramic powder (e.g., alumina) and a reactive ceramic powder (e.g., boron carbide), the inert ceramic powder having an average particle size equal to or greater than the average particle size of the reactive ceramic powder, forming the mixture into a porous body and consolidating the porous body in the presence of a metal (e.g., aluminum) to form the ceramic-metal composite.

15 Claims, No Drawings

CERAMIC-METAL COMPOSITE AND METHOD TO FORM SAID COMPOSITE

This application is a divisional of prior application Ser. No. 09/133,109, filed Aug. 12, 1998.

FIELD OF THE INVENTION

This invention relates to ceramic-metal composites.

BACKGROUND OF THE INVENTION

Recently ceramics have been used to make computer components such as disks and E-blocks for hard drives. Ceramics are starting to be used instead of metals (e.g., aluminum) for these components because of their low density and high stiffness. However, ceramics generally have a low toughness (i.e., break easier than metals) and are difficult and costly to form into the final component shape.

More recently an infiltrated aluminum-boron carbide (ABC) composite has been utilized for the above computer components (U.S. Pat. No. 5,672,435). These composites overcome some of the problems of ceramics such as difficulty in forming the part. However these composites require a substantial amount of costly fine boron carbide powder. Also, in making high stiffness ABC composites, almost all of the aluminum must be reacted to form aluminum boride, aluminum borocarbide or aluminum carbide ceramic phases. Consequently, the high stiffness ABC generally has a low toughness and consequently breaks similarly to a ceramic.

Accordingly, it would be desirable to provide a material that overcomes one or more of the problems of the prior art such as one of those described above. It would also be desirable to provide a method of preparing the material.

SUMMARY OF THE INVENTION

A first aspect of the invention is a ceramic-metal composite comprised of an inert ceramic embedded and dispersed in a matrix comprised of a metal, a reactive ceramic and at least one reactive ceramic-metal reaction product wherein grains of the inert ceramic have an average grain size greater than or equal to the average grain size of grains of the reactive ceramic.

A second aspect of the present invention is a method for preparing a ceramic-metal composite, the method comprising, a) forming a mixture comprised of an inert ceramic powder and a reactive ceramic powder, the inert ceramic powder having an average particle size equal to or greater than the average particle size of the reactive ceramic powder, b) forming the mixture of step (a) into a porous body and c) consolidating the porous body in the presence of a metal to form the ceramic-metal composite wherein the composite has at least one reactive ceramic-metal reaction product.

Surprisingly, the method according to the invention produces a ceramic-metal composite that may be as stiff or stiffer than a ceramic-metal body produced using about the same amount of metal and only the reactive ceramic powder. Or, in other words, as stiff or stiffer than a ceramic-metal composite devoid of the inert ceramic. This is surprising since metals generally are much less stiff—that is to say they have a much lower elastic moduli—than ceramics. And, the amount of residual metal would be higher in a composite formed from a porous body having less reactive ceramic powder (i.e., a body containing inert ceramic powder). This surprising stiffness generally coincides with the inert ceramic powder having an average particle size equal to or greater than the reactive ceramic powder. This surprising effect occurs even when the inert ceramic powder, for example, makes up greater than about 40% by volume of the porous body.

The ceramic-metal composite may be used in applications benefiting from properties such as low density and high stiffness. Examples of components include hard drive components (e.g., E-blocks, suspension arms, disks, bearings, actuators, clamps, spindles, base plates and housing covers); brake components (e.g., brake pads, drums, rotors, housings and pistons); aerospace components (e.g., satellite mirrors, housings, control rods, propellers and fan blades); piston engine components (e.g., valves, exhaust and intake manifolds, cam followers, valve springs, fuel injection nozzles, pistons, cam shafts and cylinder liners) and other structural or recreational components (e.g., bicycle frames, robot arms, deep sea buoys, baseball bats, golf clubs, tennis rackets and arrows).

DETAILED DESCRIPTION OF THE INVENTION

The Ceramic-Metal Composite

The ceramic-metal composite is comprised of an inert ceramic embedded and dispersed in a matrix. The matrix is comprised of a metal, a reactive ceramic and at least one reactive ceramic-metal reaction product. The reactive ceramic-metal reaction product is a reaction product of the reactive ceramic and the metal. The metal may be any metal capable of reacting with the reactive ceramic to form the reaction product. Preferred metals include silicon, magnesium, aluminum, titanium, vanadium, chromium, iron, copper, nickel, cobalt, tantalum, tungsten, molybdenum, zirconium, niobium, alloys of the previously mentioned metals and mixtures thereof. More preferred metals include aluminum, silicon, titanium, magnesium, alloys and mixtures thereof. Most preferably the metal is aluminum and alloys of aluminum, such as those that contain one or more of Cu, Mg, Si, Mn, Cr and Zn. Exemplary aluminum alloys include Al—Cu, Al—Mg, Al—Si, Al—Mn—Mg and Al—Cu—Mg—Cr—Zn. Specific examples of aluminum alloys include 6061 alloy, 7075 alloy and 1350 alloy, each available from the Aluminum Company of America, Pittsburgh, Pa.

The amount of metal in the matrix may be any useful amount, but generally is at most about 50% by volume of the matrix. Preferably the amount of metal is at most about 40%, more preferably at most about 25%, even more preferably at most about 20% and most preferably at most about 15% to preferably at least about 1%, more preferably at least about 2% and most preferably at least about 3% by volume of the matrix.

The reactive ceramic may be any ceramic capable of reacting with the metal to form the reactive ceramic-metal reaction product in the ceramic-metal composite. The reactive ceramic may be, depending on the metal, a boride, oxide, carbide, nitride, silicide or combinations or mixtures of these. Combinations include, for example, borocarbides, oxynitrides, oxycarbides and carbonitrides. Boron containing ceramics such as a boride, borocarbide and boron carbide are generally preferred. Examples of specific preferred reactive ceramics include $B_4C$, $TiB_2$, $SiB_6$, $SiB_4$, ZrC, ZrB or mixtures thereof. The most preferred reactive ceramic is boron carbide.

The reactive ceramic-metal reaction product may be any ceramic that is a reaction product of the metal and the reactive ceramic. For example, a preferred ceramic-metal composite is a boron carbide-aluminum composite containing; an inert ceramic (i.e., $Al_2O_3$), a reactive ceramic (i.e., $B_4C$) and a reactive ceramic-metal reaction product such as $AlB_2$, $Al_4BC$, $Al_3B_{48}C_2$, $AlB_{12}$, $Al_4C_3$ and $AlB_{24}C_4$.

The inert ceramic is a ceramic that essentially fails to react with the metal, which generally coincides with less than about 5% by volume of the inert ceramic reacting with the metal to form a reaction product under the conditions used to form the composite. Preferably, less than 3%, more preferable less than 1% and most preferably essentially 0% by volume of the inert ceramic reacts with the metal. The inert ceramic essentially failing to react with the metal, generally, coincides with the ceramic-metal composite containing less than about 2% by volume of a metal-inert ceramic reaction product. The amount of metal-inert ceramic reaction product may be determined by a known technique such as X-ray diffraction. Preferably, the ceramic-metal composite contains at most about 0.5% by volume, more preferably at most about 0.1% by volume and most preferably essentially no metal-inert ceramic reaction product.

Ceramics that may be suitable as inert ceramics include, for example, borides, oxides, carbides, nitrides, silicides or combinations thereof. Examples of combinations include borocarbides, oxynitrides, oxycarbides and carbonitrides. Preferably, the inert ceramic is silicon carbide, aluminum nitride, aluminum oxide or mixtures thereof.

The inert ceramic is embedded and dispersed in the matrix and has an average grain size equal to or greater than the average grain size of the reactive ceramic grains of the matrix (e.g., $B_4C$ grains in the boron carbide-aluminum composite described above). Preferably, the average grain size of the inert ceramic grains is at least about 1.5 times greater, more preferably at least about 2 times greater and most preferably at least about 5 times greater to preferably at most about 100 times greater than the average grain size of the reactive ceramic grains. The grain size may be determined by known metallographic techniques including quantitative stereology of a scanning electron micrograph of a polished section of the composite using the intercept method described by Underwood in *Quantitative Stereology*, Addison-Wesley, Reading, Mass. (1970).

In a more preferred embodiment, the inert ceramic preferably has an average grain size equal to or greater than the average grain size of the ceramic grains of the matrix (i.e., matrix ceramic grains). The matrix ceramic grains include the grains of the reactive ceramic and reactive ceramic-metal reaction product. For example, the matrix ceramic grains of the boron carbide-aluminum-$Al_2O_3$ composite described above include boron carbide grains and any one of the ceramic grains resulting from the reaction of boron carbide with aluminum (e.g., $AlB_2$, $Al_4BC$, $Al_3B_{48}C_2$, $AlB_{12}$, $Al_4C_3$ and $AlB_{24}C_4$). Preferably the average grain size of the inert ceramic grains is at least about 1.5 times greater, more preferably at least about 2 times greater and most preferably at least about 5 times greater to preferably at most about 100 times greater than the average grain size of the matrix ceramic grains.

The inert ceramic may comprise any useful amount (i.e., generally at least about 10% by volume) of the ceramic-metal composite provided that the inert ceramic grains are embedded and dispersed throughout the matrix. Generally, the matrix is contiguous in at least 2 dimensions. Consequently, the amount of inert ceramic generally comprises at most about 90% of the ceramic-metal composite. It is preferred to use as much inert ceramic to provide a stiff and yet less expensive composite (i.e., replace expensive reactive ceramic powder with inexpensive inert ceramic powders). Preferably, the amount of inert ceramic in the composite is at least about 25%, more preferably at least about 30%, even more preferably at least about 40% and most preferably at least about 50% by volume of the composite.

In general, the ceramic-metal composite has a density of at least about 90% of theoretical density. Preferably, the composite has a density of at least about 95%, more preferably at least about 98%, even more preferably at least about 99% and most preferably essentially 100% of theoretical density. The ceramic-metal composite generally has a stiffness (i.e., Young's modulus) equal to or greater than a composite made in the absence of the inert ceramic (i.e., a composite of just the metal and reactive ceramic made under the same conditions). Preferably, the ceramic-metal composite has a stiffness greater than a composite made in the absence of the inert ceramic.

To reiterate, the ceramic-metal composite may be as stiff or stiffer than a ceramic-metal body produced from a porous body made with the same amount of the metal and (1) just the inert ceramic or (2) just the reactive ceramic. Preferably, the ceramic-metal composite is as stiff or stiffer (i.e., higher Young's modulus) than the just described (1) and (2) ceramic-metal composites. More preferably the ceramic-metal composite is stiffer.

Generally, it is desirable for the ceramic-metal composite to have a low bulk density for use in components such as hard drive components. Preferably the bulk density of the composite is at most about 6 grams per cubic centimeter (g/cc), more preferably at most about 4 g/cc and most preferably at most about 3 g/cc. Similarly it is preferable for the composite to have a stiffness, as given by Young's modulus, of at least about 150 GPa, more preferably at least about 200 GPa, even more preferably at least about 225 GPa and most preferably at least about 250 GPa to preferably at most about 2000 GPa.

Forming of the Ceramic-Metal Composite

The ceramic-metal composite may be made by any suitable technique including a convenient or known powdered metal or ceramic processing technique. Generally, in forming the composite, a shaped porous body is formed followed by a consolidation technique and, if desired, finishing the article to a final shape. Two typical consolidation routes which may be used to form the ceramic-metal composite of this invention are (1) infiltrating a porous body comprised of the inert ceramic powder and reactive ceramic powder with the metal and (2) densifying a porous body comprised of the metal and inert and reactive ceramic powders. The infiltrated or densified body may then be finished (i.e., machined) by techniques such as diamond grinding, laser machining and electro discharge machining. The consolidated or finished body may also be heat treated to alter the microstructure and increase, for example, the Young's modulus. Preferably the composite is made by infiltration.

The inert ceramic powder and reactive ceramic powder have the same chemistry as previously described for the inert ceramic and reactive ceramic of the ceramic-metal composite. The metal used in consolidating the porous body is the same as the metal of the ceramic-metal composite previously described.

The inert ceramic powder generally has an average particle size greater than or equal to the reactive ceramic powder. The average size of the inert ceramic powder and reactive ceramic powder may conveniently be given by the specific surface area of each powder (i.e., $m^2/g$). Since the specific surface area of a powder is inversely proportional to the size of the powder, it is preferred that the inert ceramic powder has a surface area less than or equal to the specific surface area of the reactive ceramic powder. More preferably, the inert ceramic powder has a specific surface area that is about half (½) or less and most preferably a third (⅓) or less than the specific surface area of the reactive ceramic powder. For example, if the specific surface area of the reactive ceramic powder is 10 $m^2/g$, it is preferred that the inert ceramic powder has a specific surface area of less than 10 $m^2/g$, more preferably less than about 5 $m^2/g$ and most preferably less than about 3 $m^2/g$.

Generally, the particle size of each ceramic powder used to form the ceramic-metal composite has an average particle size by weight of at most about 1000 micrometers, preferably at most about 500 micrometers, more preferably at most about 100 micrometers ($\mu$m), and most preferably at most about 50 $\mu$m in diameter. The particles of each ceramic powder desirably have an equivalent spherical particle diameter within a range of about 0.1 to about 100 micrometers.

The powders (e.g., reactive ceramic and inert powders) used to make the porous body may be mixed by any suitable method such as those known in the art. Examples of suitable methods include ball milling, attrition milling, ribbon blending, vertical screw mixing, V-blending and fluidized zone mixing. Ball milling in a solvent such as ethanol, heptane, methanol, acetone and other low molecular weight organic solvents with milling media, such as alumina and boron carbide media, generally provides satisfactory results. Other additives useful in the formation of the porous body from the mixture may be included such as dispersants, binders and solvent.

Suitable methods to form the porous body for infiltrating or densifying include, for example, shaping methods such as slip or pressure casting, pressing and plastic forming methods (e.g., jiggering, injection molding and extrusion). The forming of the porous body may include removing, if necessary, solvent and organic additives such as dispersants and binders after shaping of the mixture. Each of the above methods and steps are described in more detail in Introduction to the Principles of Ceramic Processing, J. Reed, J. Wiley and Sons, N.Y., 1988.

The porous body may be any density that is still capable of forming the ceramic-metal composite. The density generally ranges from about 40% to about 85% of theoretical density. Preferably the density of the porous body is at least about 45%, more preferably at least about 50%, most preferably at least about 60% to preferably at most about 80% and more preferably at most about 75% of theoretical density.

The porous body, when containing the metal, may be densified into the ceramic-metal composite by techniques such as vacuum sintering, atmospheric pressure (pressureless) sintering, pressure assisted sintering such as hot pressing, hot isostatic pressing and rapid omni directional compaction and combinations thereof, each pressure assisted technique is further described in Annu. Rev. Mater. Sci., 1989, [19], C. A. Kelto, E. E. Timm and A. J. Pyzik, pp. 527–550.

The porous body, when containing the metal, is densified under conditions of time, atmosphere, temperature and pressure sufficient to form the metal-ceramic composite. The temperature is typically greater than about 75% of the melt temperature in degrees C of the metal but less than a temperature where substantial volatilization of the metal occurs. For example, the densification temperature for an aluminum-boron carbide system is preferably between 500° C. to 1350° C. The time is desirably as short as possible. Preferably the time is at most about 24 hours, more preferably at most about 2 hours, and most preferably at most about 1 hour. The pressure is desirably ambient or atmospheric pressure but may be greater than atmospheric pressure to facilitate consolidation of the porous body. The atmosphere is desirably one that does not adversely affect the densification or chemistry of the ceramic-metal composite (i.e., it is desirable for the atmosphere to fail to react with the components of the porous body and metal).

Preferably, the ceramic-metal composite is produced by infiltrating a metal into the porous body comprised of the reactive and inert ceramic powder. The infiltrated body may be further consolidated by techniques described previously. A preferred embodiment is aluminum metal infiltration of a porous body comprised of boron carbide powder (i.e., the reactive ceramic powder) and an inert ceramic powder. Preferred inert ceramic powders include alumina, silicon carbide, aluminum nitride or mixtures thereof. More preferably the inert ceramic powder is alumina.

Infiltration is the process in which a liquid metal fills the pores of the porous body in contact with the metal. Infiltration of the porous preform may be performed by any convenient method for infiltrating a metal into a preform body, such as vacuum infiltration, pressure infiltration and gravity/heat infiltration provided that the atmosphere is essentially inert to the metal and components of the porous body (e.g., vacuum or inert gas such as a noble gas). Examples of suitable infiltration methods are described by U.S. Pat. Nos. 4,702,770 and 4,834,938, each incorporated herein by reference.

The temperature of infiltration is dependent on the metal to be infiltrated. Infiltration is preferably performed at a temperature where the metal is molten but below a temperature at which the metal rapidly volatilizes. For example, when infiltrating aluminum or an alloy thereof into the porous body, the temperature is preferably at most about 1300° C., and more preferably at most about 1200° C. and preferably at least about 750° C., and more preferably at least about 900° C. The infiltration time can be any time sufficient to infiltrate the porous body to form the ceramic-metal composite.

After the ceramic-metal composite is formed it may be additionally heat treated, for example, to increase its strength. This additional heat treatment may vary over a wide range of conditions (e.g., temperature, time, pressure and atmosphere) and depends on the particular ceramic-metal composite. For example, in a boron carbide-aluminum-alumina composite, the composite generally is heat treated at a temperature from about 660° C. to about 1250° C., preferably from about 660° C. to about 1100° C., and more preferably from about 800° C. to about 950° C. for a time sufficient to allow reactions between the metal aluminum, boron carbide and boron carbide-aluminum reaction products to occur.

Below are specific examples within the scope of the invention and comparative examples. The specific examples are for illustrative purposes only and in no way limit the invention described herein.

EXAMPLES

Example 1

A ceramic-metal composite was made by first mixing about 51 parts by weight (pbw) of alumina (i.e., inert ceramic powder) having a specific surface area of about 3.3 $m^2/g$ with about 49 parts by weight (pbw) of boron carbide (i.e., reactive ceramic powder) having a surface area of about 11 $m^2/g$. The powders were mixed with about 7.4 pbw of paraffin wax in a ball mill using heptane and boron carbide milling media for about 8 hours. After mixing, the media and heptane were removed by screening and drying. The dried mixture was pressed in a die to form a porous body containing the paraffin wax. The wax was removed by heating to 600° C. under flowing nitrogen to produce a porous body that was about 42% porous by volume (i.e., the porous body had a density of about 58% of theoretical density "$\rho_{th}$")

The porous body was placed on a piece of aluminum in a refractory crucible. This assemblage was placed in a furnace. The furnace was heated to 1160° C. and maintained at that temperature for about 3 hours under vacuum to infiltrate the porous body with aluminum. The resultant ceramic-metal composite had a stiffness (i.e., Young's Modulus) of 278 GPa and had a density that was essentially 100% of theoretical density($\rho_{th}$), also shown in Table 1.

Example 2

In Example 2, a ceramic-metal composite was made by the same method of Example 1 except that the grade of boron carbide was different as shown in Table 1. The resultant ceramic-metal composite's stiffness and density are shown in Table 1.

Example 3

A ceramic-metal composite was made by first mixing 51 parts by weight (pbw) of alumina (i.e., inert ceramic powder) having a specific surface area of about 9.6 $m^2/g$ with 49 parts by weight (pbw) of boron carbide (i.e., reactive ceramic powder) having a surface area of about 11 $m^2/g$. The powders were mixed, for about 8 hours, in a ball mill using methanol and boron carbide milling media. After mixing, the media and methanol were removed by screening and drying. The dried mixture was pressed in a die to form a porous body that was about 43% porous by volume (i.e., the porous body had a density of about 57% of theoretical density "$\rho_{th}$")

The porous body was placed on a piece of aluminum in a refractory crucible. This assemblage was placed in a furnace. The furnace was heated to about 1160° C. and maintained at that temperature for about 3 hours under vacuum to infiltrate the porous body with aluminum. The resultant ceramic-metal composite had a stiffness (i.e., Young's Modulus) of about 270 GPa and had a density that was essentially 100% of theoretical density($\rho_{th}$), as shown in Table 1.

Example 4

In Example 4, a ceramic-metal composite was made by the same method of Example 3 except that the grade of boron carbide was different as shown in Table 1. The resultant ceramic-metal composite's stiffness and density are shown in Table 1.

Comparative Example 1

In Comparative Example 1 a ceramic-metal composite was formed by the same process as described in Example 4 except that no alumina powder was used. The stiffness and density of the composite is shown in Table 1.

Comparative Examples 2 and 3

In Comparative Examples 2 and 3, a ceramic-metal composite was formed by the same process as described in Example 3 except that the alumina was different and the boron carbide was different for Comparative Example 3 as shown in Table 1. The density and the stiffness of these composites are shown in Table 1.

As shown in Table 1, a ceramic-metal composite made using an inert ceramic powder ($Al_{2\ O3}$) having a specific surface area less than the specific surface area of the reactive ceramic powder ($B_4C$) results in a composite having a stiffness comparable (i.e., within 10% of the stiffness) if not at least equal to the stiffness of a composite made using only the reactive ceramic (see Examples 1–4 and Comparative Example 1). Comparative Examples 2 and 3 show that this result is not obtained when using inert ceramic powder having a specific surface area greater than the reactive ceramic powder surface area.

Example 5

In Example 5, a ceramic-metal composite was formed by the same process described in Example 3 except that the boron carbide had a specific surface area of 4.4 $m^2/g$ and the alumina had a specific surface area of 3.3 $m^2/g$ as shown in Table 1. The density and stiffness of this composite are shown in Table 1.

Comparative Example 4

A ceramic-metal composite was formed by the same process described in Example 5 except that the alumina powder had a specific surface area of 9.6 $m^2/g$ as shown in Table 1. The density and stiffness of this composite are also shown in Table 1.

The porous body of Example 5 was less dense than the porous body of Comparative Example 4. Thus, to make a fully dense ceramic-metal composite, the porous body of Example 5 required more metal (i.e., aluminum) to be infiltrated than the porous body of Comparative Example 4. Even so, the composite of Example 5 had a much higher stiffness than the one made in Comparative Example 4. This clearly demonstrates the surprising effect of using an inert ceramic powder (i.e., alumina) having a larger average particle size (i.e., lower specific surface area) than the reactive ceramic powder (i.e., boron carbide) in forming a ceramic-metal composite having a high stiffness.

TABLE 1

| Sample | $Al_2O_3$ Grade | $B_4C$ Grade | $Al_2O_3$ (pbw) | $B_4C$ (pbw) | $Al_2O_3$ Surface Area ($m^2/g$) | $B_4C$ Surface Area ($m^2/g$) | Density of Porous Body (% of $\rho_{th}$) | Density of Composite (% of $\rho_{th}$) | Stiffness (GPa) |
|---|---|---|---|---|---|---|---|---|---|
| Example 1 | A17 | F3000 | 51 | 49 | 3.3 | 11 | 58 | ~100 | 278 |
| Example 2 | A17 | F1500 | 51 | 49 | 3.3 | 11 | 56 | ~100 | 261 |

TABLE 1-continued

| Sample | $Al_2O_3$ Grade | $B_4C$ Grade | $Al_2O_3$ (pbw) | $B_4C$ (pbw) | $Al_2O_3$ Surface Area ($m^2/g$) | $B_4C$ Surface Area ($m^2/g$) | Density of Porous Body (% of $\rho_{th}$) | Density of Composite (% of $\rho_{th}$) | Stiffness (GPa) |
|---|---|---|---|---|---|---|---|---|---|
| Example 3 | A16-SG | F3000 | 51 | 49 | 9.6 | 11 | 57 | ~100 | 270 |
| Example 4 | A16-SG | F1500 | 51 | 49 | 9.6 | 11 | 58 | ~100 | 241 |
| Example 5 | A17 | −8 μm | 51 | 49 | 3.3 | 4.4 | 60 | ~100 | 251 |
| Comparative Example 1 | — | F1500 | — | 100 | — | 11 | 57 | ~100 | 259–280 |
| Comparative Example 2 | −0.2 μm | F3000 | 51 | 49 | 43 | 11 | 47 | ~100 | 200 |
| Comparative Example 3 | −0.2 μm | F1500 | 51 | 49 | 43 | 11 | 46 | ~100 | 180 |
| Comparative Example 4 | A16-SG | −8 μm | 51 | 49 | 9.6 | 4.4 | 62 | ~100 | 214 |

F3000, F1500 and −8 μm grades of boron carbide available from Elektroschemeltzwerk Kempten, Munich Germany.
A17 and A16-SG (Superground) alumina available from Aluminum Co. of America, Pittsburgh, PA).
−0.2 μm alumina available from CERALOX, Div. Of CONDEA Vista Co., (Tucson, AZ).
~100 essentially 100% of theoretical density.

What is claimed is:

1. A ceramic-metal composite comprising an intert ceramic embedded and dispersed in a matrix comprised of a metal, a reactive ceramic and a reactive ceramic-metal reaction product wherein particles of the inert ceramic have an average particle size greater than or equal to the average particle size of particles of the reactive ceramic, wherein the reactive ceramic is a boron containing ceramic, wherein the average particle size of the inert ceramic is less than about fifty micrometers and wherein the ceramic metal composite is at least as stiff as a composite devoid of the inert ceramic and prepared with about the same volume of the metal as the ceramic-metal composite.

2. The ceramic-metal composite of claim 1 wherein the average particle size of the inert ceramic is less than about twenty five micrometers.

3. The ceramic-metal composite of claim 2 wherein the average particle size of the inert ceramic is less than about twelve micrometers.

4. The ceramic-metal composite of claim 2 wherein the ceramic-metal composite is stiffer than a composite devoid of the inert ceramic and prepared with about the same volume of the metal as the ceramic-metal composite.

5. The ceramic-metal composite of claim 1 wherein the reactive ceramic is boron carbide.

6. The ceramic-metal composite of claim 5 wherein the inert ceramic is aluminum oxide, aluminum nitride or silicon carbide.

7. The ceramic-metal composite of claim 6 wherein the inert ceramic is aluminum oxide and the metal is aluminum.

8. The ceramic-metal composite of claim 7 wherein the reactive ceramic-metal reaction product is comprised of $AlB_2$, $Al_4BC$, $Al_3B_{48}C_2$, $AlB_{12}$, $Al_4C_3$, $AlB_{24}C_4$ or mixtures thereof.

9. The ceramic-metal composite of claim 8 wherein the ceramic-metal composite is stiffer than the composite devoid of the inert ceramic.

10. The ceramic-metal composite of claim 1 wherein the ceramic-metal composite contains an amount of inert ceramic of at least about 40% to at most about 90% by volume of the ceramic-metal composite.

11. The ceramic-metal composite of claim 10 wherein the ceramic-metal composite has a Young's modulus of at least about 200 GPa.

12. The ceramic-metal composite of claim 2 wherein the ceramic-metal composite contains an amount of inert ceramic of at least about 40% to at most about 90% by volume of the ceramic-metal composite.

13. The ceramic-metal composite of claim 4 wherein the ceramic-metal composite contains an amount of inert ceramic of at least about 40% to at most about 90% by volume of the ceramic-metal composite.

14. The ceramic-metal composite of claim 13 wherein the ceramic-metal composite has a Young's modulus of at least about 200 GPa.

15. The ceramic-metal composite of claim 9 wherein the ceramic-metal composite contains an amount of inert ceramic of at least about 40% to at most about 90% by volume of the ceramic-metal composite.

* * * * *